United States Patent [19]

Redick, Jr.

[11] Patent Number: 4,557,399

[45] Date of Patent: Dec. 10, 1985

[54] ADAPTER FOR BOTTLED WATER DISPENSER

[76] Inventor: Richard W. Redick, Jr., 612 Oak Haven Dr., Falls Church, Va. 22046

[21] Appl. No.: 394,793

[22] Filed: Jul. 2, 1982

Related U.S. Application Data

[62] Division of Ser. No. 117,840, Jan. 30, 1980, Pat. No. 4,341,325.

[51] Int. Cl.[4] ..... B67B 7/24; B67D 1/16

[52] U.S. Cl. ..... 222/83.5; 222/108; 222/183; 141/18; 141/329; 211/74; 312/107; 312/111

[58] Field of Search ..... 222/80, 81, 88, 108, 222/129, 130, 131, 145, 173, 180, 181, 183, 185, 109, 110, 129.1, 85, 136, 325, 86; 141/329, 18, 19, 330, 105–107, 382–386; 248/127, 146, 676; 220/319, 320; 215/273–275; 312/107, 111; 211/71, 74

[56] References Cited

U.S. PATENT DOCUMENTS

| | | | |
|---|---|---|---|
| 166,889 | 8/1875 | Porter | 222/108 |
| 285,967 | 10/1883 | Chapman | 222/108 |
| 2,774,393 | 12/1956 | Swan | 222/129 X |
| 2,895,653 | 7/1959 | Giepen | 222/498 X |
| 3,035,737 | 5/1962 | Speas | 222/88 X |
| 3,792,797 | 2/1974 | Mrusek et al. | 215/275 X |
| 3,825,154 | 7/1974 | Jaeger | 222/136 |
| 3,843,021 | 10/1974 | Schieser | 222/185 X |
| 3,933,275 | 1/1976 | Metzner et al. | 211/74 X |
| 3,998,362 | 12/1976 | Lapierre et al. | 222/185 |
| 4,177,934 | 12/1979 | Hammes et al. | 215/275 X |
| 4,274,557 | 6/1981 | Shannon | 222/136 |
| 4,429,812 | 2/1984 | Steiner et al. | 222/181 |

FOREIGN PATENT DOCUMENTS

| | | | |
|---|---|---|---|
| 616328 | 1/1927 | France | 222/88 |

*Primary Examiner*—Joseph J. Rolla
*Assistant Examiner*—Kevin P. Shaver
*Attorney, Agent, or Firm*—Harvey B. Jacobson

[57] ABSTRACT

An adapter used in association with conventional bottled water dispensers which normally accept five gallon bottles of water and dispense hot or cold water or only cold water into a receptacle upon actuation of a manually operated spigot. The adapter enables multiple smaller containers to be supported on top of an existing water dispenser after the water bottle has been removed therefrom with the existing reservoir or reservoirs on the dispenser being provided with a closure uniquely communicating the reservoir with the multiple containers in a quick, easy and sanitary manner. The adapter also includes a support structure for the multiple containers, a spill plate which channels any water spills into the regular overflow basin of the dispenser and fittings, connectors and valve assemblies associated with the containers. In one embodiment of the invention, the adapter is connected to the existing valve structure on the container, in another embodiment a unique new valve and associated structure is provided on the container and in a third embodiment of the invention, a unique container is provided together with a connector structure which includes a feature which penetrates the peripheral wall of a container when the container is placed in its supporting structure.

4 Claims, 16 Drawing Figures

215
214
192
186
198
170
182
186
184
210
13
210
172
13
176
212
174
178

220
190
186
15
15
186
208
220
188
190

202
200
200
218

230
228
190
226
222
220
224
204

192
194
190

190
188
186
190
190
186
230
226
210
206
208
196
222
204
206
216
202
200
174
130

ADAPTER FOR BOTTLED WATER DISPENSER

This application is a division of application Ser. No. 117,840, filed Jan. 30, 1980, now U.S. Pat. No. 4,341,325 issued July 27, 1982.

BACKGROUND OF THE INVENTION

1. Field of the Invention

The present invention generally relates to an adapter and more particularly an adapter for converting existing bottled water dispensers to a dispenser capable of receiving multiple containers, each having less capacity then a conventional glass bobble used for this purpose, and a unique arrangement for connecting multiple containers to an existing component of the water dispenser.

2. Description of the Prior Art

Water dispensers of the type receiving water in large glass bottles have been used for many years in various orientations. Such structures usually include a five gallon water bottle positioned in inverted position for water flow from the bottle by gravity into a reservoir from which water is withdrawn by a spigot or faucet. Such dispensers are capable of dispensing cold water only or in some instances, cold or hot water may be dispensed through manually actuated spigots or faucets into a drinking receptacle or other receptacle in a well-known manner. The normal procedure for replacing the glass bottle when the water therein has been dispensed is for the glass bottle to be replaced with a filled bottle. The existing glass bottles are rather heavy and unwieldly and considerable breakage occurs and, in addition, when the empty or partially empty bottle is removed and a full bottle is placed in position on the dispenser, there is a frequent occurrence of spillage at the site of the dispenser. In addition, the large bottles must be transported to and from the filling plant and must be sterilized before refilling and the actual replacement procedure requires considerable time as well as considerable strength and manual dexterity on the part of the person doing the replacement. For these and other reasons, efforts have been made to replace the large returnable glass bottles with smaller, more easily handled, disposable containers. Prior U.S. Pat. Nos. 3,212,681; 3,223,117; 3,430,824 and U.S. Pat. No. Des. 224,639 disclose containers of this general type which are used for dispensing various type of liquids. U.S. Pat. No. 3,843,021 discloses a liquid dispenser with a disposable container in which a float valve is provided to control the flow from the container into a reservoir which is open to the atmosphere when the container is being changed and which requires proper operation of the float valve for operation of the device.

SUMMARY OF THE INVENTION

An object of the present invention is to provide an adapter for a bottled water dispenser including a supporting structure for supporting multiple containers, a new and unique valve for such containers, unique connectors for the existing valve on such containers as well as the unique valve, a closure plug for the existing reservoir, a spill plate communicated with the conventional overflow basin of the dispenser, a vent assembly for the hot water line of a hot and cold water dispenser including a vent tank communicated with the hot water line and reservoir flow, and an optional dust cover for the containers.

Another object of the invention is to provide an adapter in accordance with the preceding object in which unique plastic containers are supported and instead of using an existing valve on the containers or a new unique valve on the containers, the connection between the reservoir and the container is made by a container penetrating member mounted in the bottom of each compartment of the supporting structure so that when a plastic container is moved into the compartment, the connector will penetrate the container thus communicating the container with the reservoir.

A further object of the invention is to provide an adapter in accordance with either embodiment of the invention as set forth in the two preceding objects which is simple in construction, easy to install on an existing bottled water dispenser, dependable and long lasting, sanitary in operation and reducing the time required for a person to service the water dispenser by replacing the containers.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
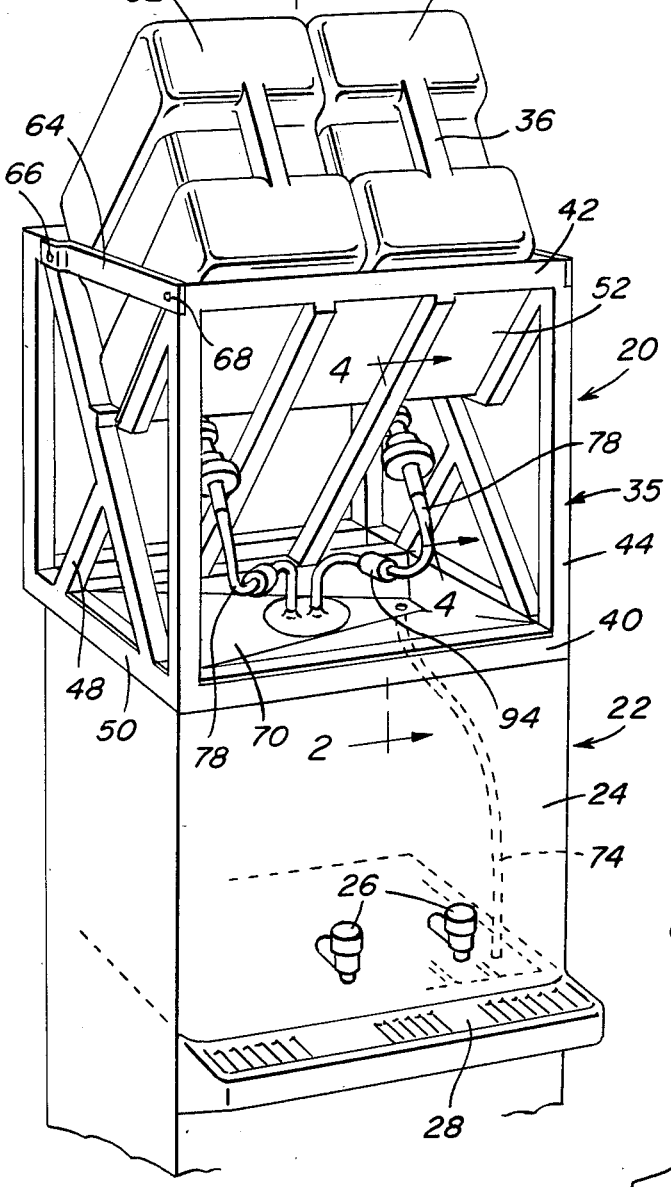
FIG. 1 is a perspective view of the adapter of the present invention associated with a water dispenser normally having a water bottle oriented in inverted position on the upper end thereof.

Referring now specifically to the drawings, the embodiment of the adapter illustrated in FIGS. 1–10 is designated generally by reference numeral 20 and is associated with a water dispenser generally designated by numeral 22 that is normally provided with an inverted water bottle on the top of a generally vertically disposed cabinet 24 in a conventional and well-known manner. The dispenser 22 is provided with one, if only cold water to be dispensed, or two faucets or spigots 26 in the front wall of the cabinet 24 in overlying relation to an overflow basin assembly 28, all of which represents conventional structure with the adapter 20 serving to be mounted directly on top of the cabinet 24. The spigots or faucets 26 are in communication with a reservoir 30 or two reservoirs in the case of hot and cold water dispensers supported in a conventional manner which is normally associated with the neck of the inverted water bottle so that water flows by gravity from the bottle into the reservoir or reservoirs 30 and provides a storage for the water as it is dispensed from the spigots or faucets 26 with suitable chilling or heating means being provided for the water being discharged. All of this structure is conventional and forms no particular part of the present invention except for its association with the adapter which enables the single, large and unwieldly glass bottle, which usually has a capacity of five gallons, to be replaced with a pair of smaller containers 32 which are generally parallelepiped in construction with one corner thereof being inclined as at 34 and one long side thereof being provided with an indented handle forming structure 36 with the container 32 being of plastic material of suitable size and configuration and one type of such container is manufactured by Liquibox Corp. and the structure of such a container is substantially disclosed the aforementioned U.S. Pat. No. Des. 224,639.

Figure 6:
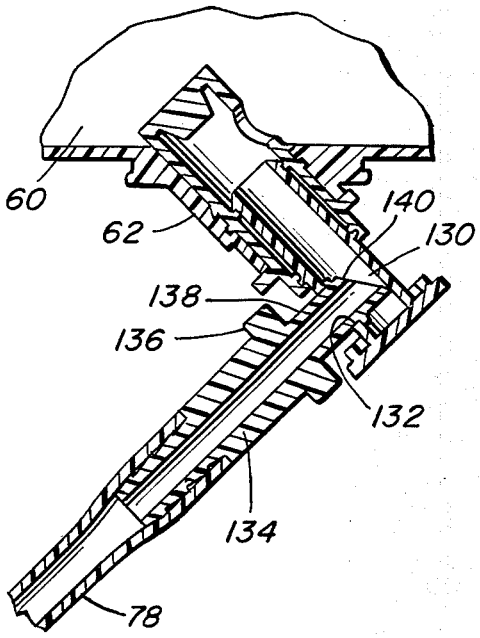
FIG. 6 is a fragmental sectional view of the connector which connects to the existing container valve.
Figure 5:
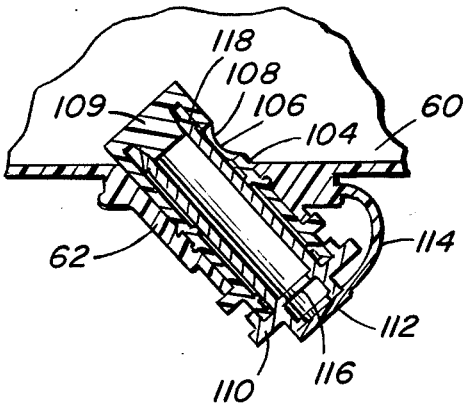
FIG. 5 is a fragmental sectional view of the container closure valve.
Figure 4:
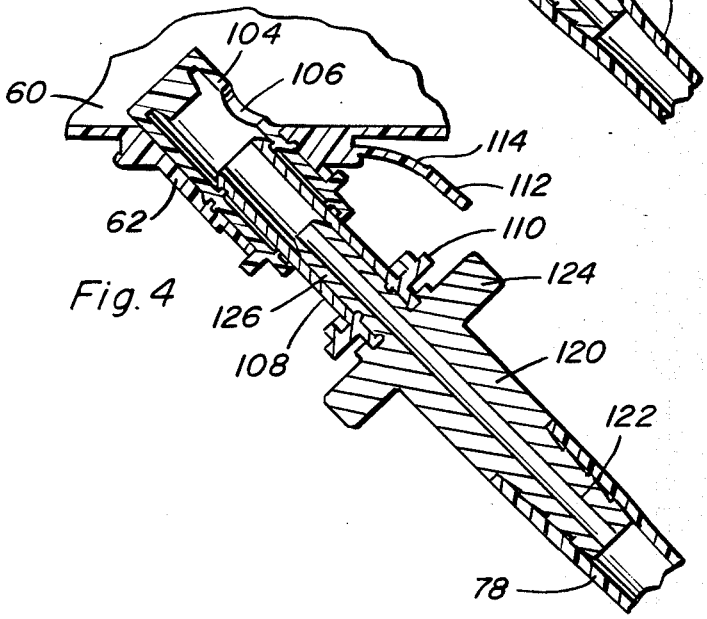
FIG. 4 is a detailed sectional view taken substantially upon a plane passing along section line 4—4 of FIG. 1 illustrating the structural details of a new valved connection between the container and flexible tube.
Figure 2:
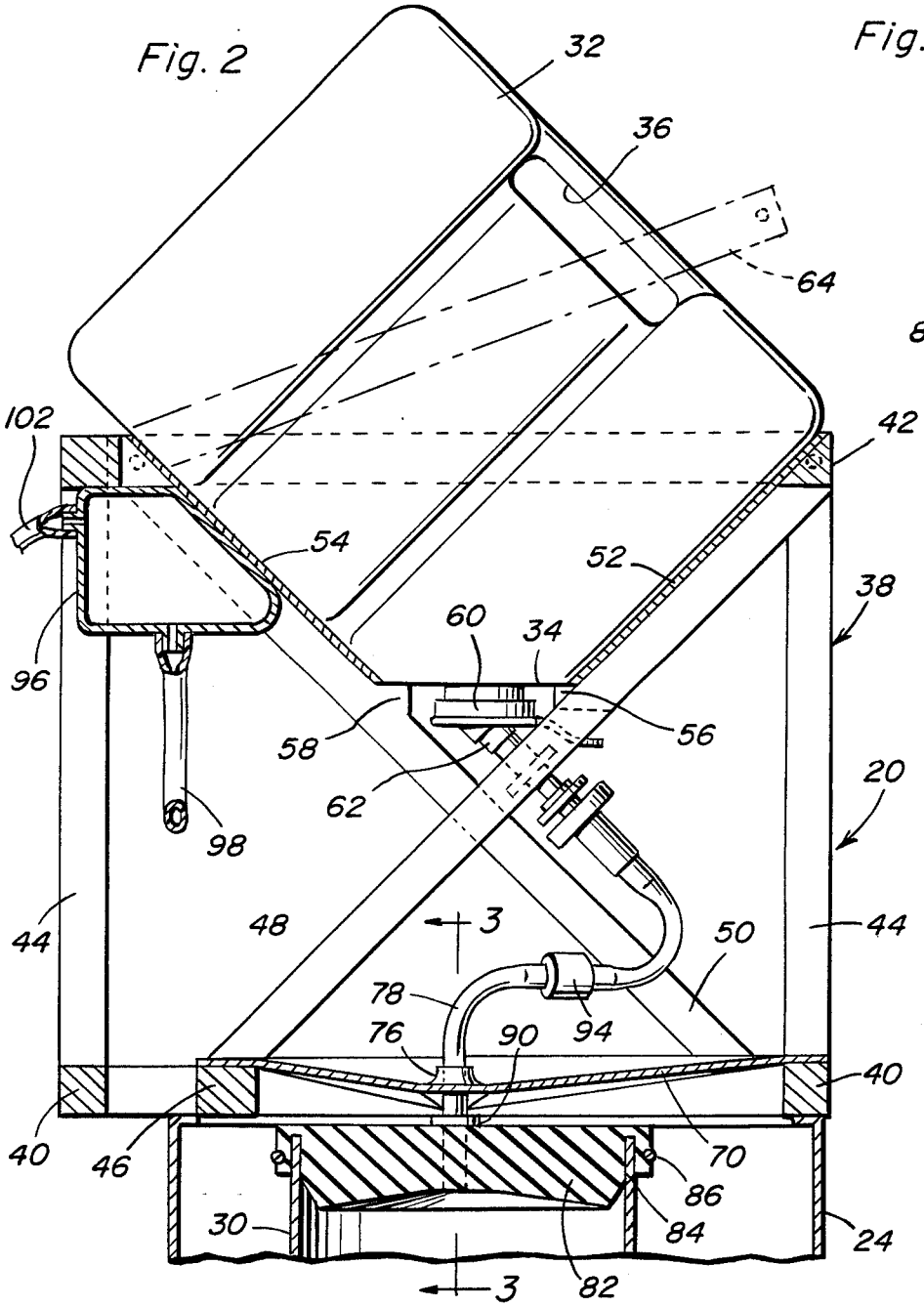
FIG. 2 is a vertical sectional view taken substantially upon a plane passing along section line 2—2 of FIG. 1 illustrating the relationship of the components of the present invention.

The adapter of the present invention includes a supporting case 38 including a bottom frame 40, an upper frame 42 and interconnecting corner members 44. The case 38 is generally square or rectangular in configuration and the bottom frame 40 includes a transverse member 46 spaced inwardly from the rearward edge thereof and upwardly extending inclined brace members 48 extend from the frame member 46 upwardly and forwardly to the front frame member of the upper frame 42 as illustrated in FIG. 2. A pair of upwardly and rearwardly inclined brace members 50 are connected to the forward side edges of the lower frame 40 and extend upwardly to the rear frame member on the upper frame 42 with the braces 48 and 50 oriented in intersecting relation as illustrated in FIGS. 1 and 2. A supporting plate 52 is supported from the upper portion of the brace members 48 and a similar supporting plate 54 is mounted on the upper surface of the braces 50 with the lower edges of the plates 52 and 54 being spaced above the point of intersection of the braces 48 and 50 as illustrated in FIG. 2 and generally in alignment with the edges of the inclined corner 34 of the container 32 with the bottom edges of the plates 52 and 54 resting against transverse support members 56 and 58, respectively, which also supports the container 32 and forms an opening for receiving a fitting 60 on the container 32 in which the fitting 60 includes a downwardly extending and inclined tubular member 62 as illustrated in FIGS. 4–6. To facilitate positioning of the containers 32 in the case 38, a pivotal retaining bar 64 forms the sides of the upper frame 42 with one end of the retaining bar 64 being pivotally attached at 66 and the other end being detachably attached at 68 to enable it to be swung to an out-of-the-way position to facilitate lateral insertion of and removal of the containers 32. When containers 32 are positioned in the cradle and connected to the reservoir, a small hole is formed in the uppermost portion of each tank to admit air as water is discharged.

Figure 8:
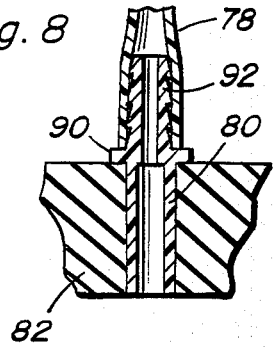
FIG. 8 is a fragmental sectional view illustrating the association of the connector fitting between the connector hose and reservoir plug.
Figure 9:
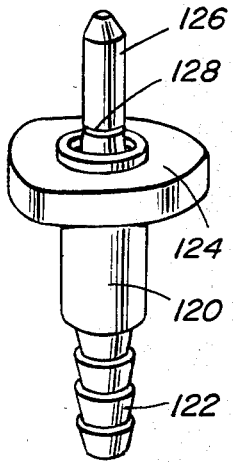
FIG. 9 is a perspective view of the connector of FIG. 4.
Figure 10:
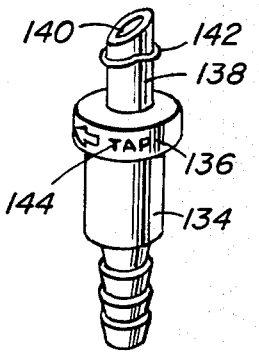
FIG. 10 is a perspective view of the connector of FIG. 6.
Figure 3:
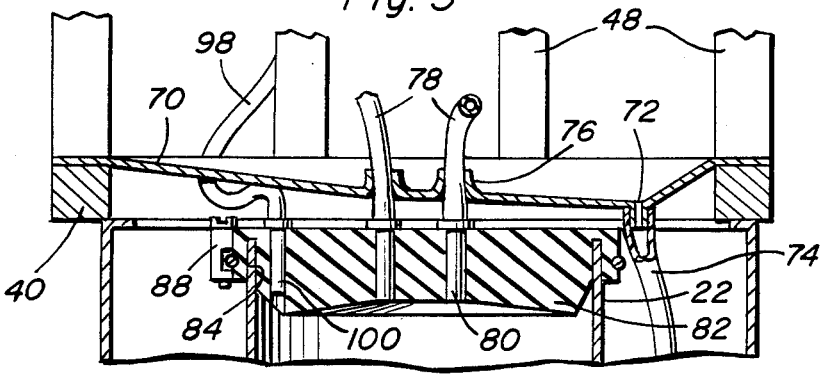
FIG. 3 is a fragmental sectional view taken substantially upon a plane passing along section line 3—3 of FIG. 2 illustrating further structural details of the reservoir plug, spill plate and associated components.
Figure 11:
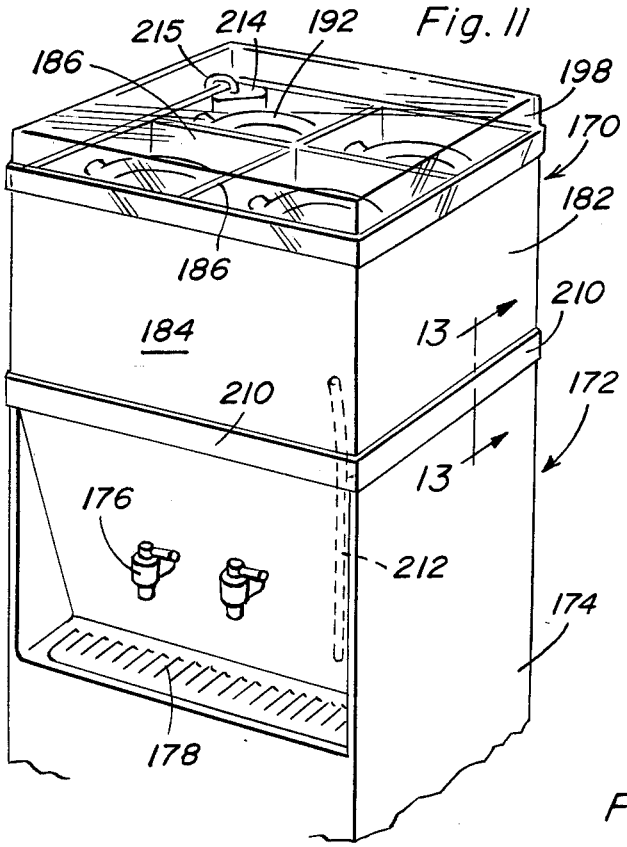
FIG. 11 is a perspective view, similar to FIG. 1, illustrating a modified form of the invention in which four plastic containers are supported.
Figure 12:
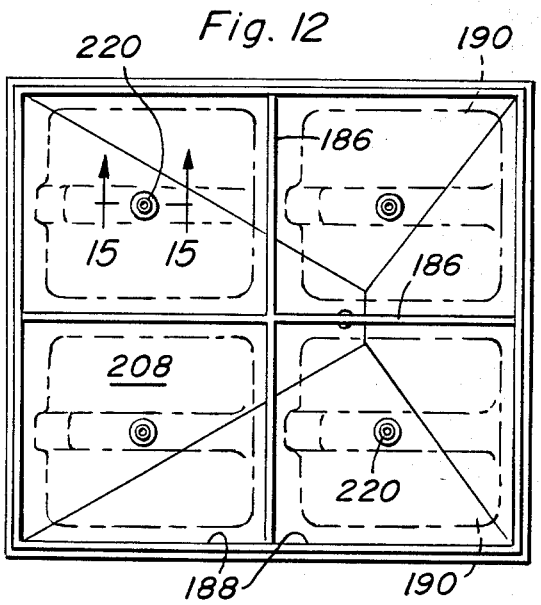
FIG. 12 is a top plan view of the construction of FIG. 11 with the optional dust cover removed.
Figure 14:
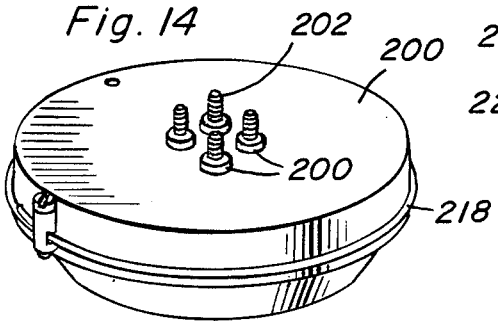
FIG. 14 is a perspective of the reservoir plug.
Figure 15:
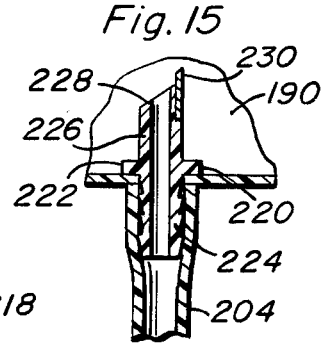
FIG. 15 is a fragmental sectional view, on an enlarged scale, taken substantially upon a plane passing along section line 15—15 of FIG. 12 illustrating further structural details of the plastic container puncture connector.
Figure 16:
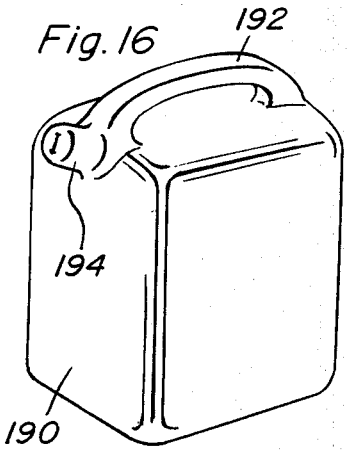
FIG. 16 is a perspective view of one of the plastic containers employed in this embodiment of the invention.

Also, the bottom frame of the case 38 is provided with a spill plate or tray 70 having an inclined or slanted bottom providing a low drain point and fitting 7 from which a hose 74 depends to the overflow basin 28. The spill tray 70 also includes a pair of upwardly deflected tubular members 76 through which a pair of connector hoses 78 extend so that any water which would tend to migrate down the external surface of the hoses 78 will be deflected off into the tray 70 since the interior of the tubular members 76 frictionally and more or less sealingly engage the outer surfaces of the hoses 78. The tubular members 76 may alternatively be in the form of rubber or plastic nipples resiliently engaging the exterior of the hose. The lower ends of the hoses 78 are connected to a fitting 80 mounted in a closure plug or stopper 82 which is telescoped into the reservoir 30 and forms a closure therefor and is constructed of rubber, plastic, or the like. The periphery of the lower surface of the plug 82 is provided with a downwardly opening groove 84 which telescopically receives the upper end of the reservoir 30 as illustrated in FIGS. 2 and 3 and the outer periphery of the plug 82 is provided with a tightening band 86 in the form of a wire rod, strap, or the like, having a tightening mechanism at one portion thereof as indicated by numeral 88 thereby enabling assembly of the plug onto the reservoir 30 and by operation of the tightening mechanism 88, the plug is sealingly secured to the upper end of the reservoir. The fitting 80 extends completely through the plug 82 and the central portion of the fitting 80 includes a flange 90 engaging the upper surface of the plug 82 and a serrated tubular extension or barb 92 with the hose 78 being forced down over the extension 92 and thus sealingly connected to the lower end of the hose 78 as illustrated in FIG. 8. Also, each of the hoses 78 is provided with a check valve assembly 94 above the spill plate or tray 70 to prevent flow from the reservoir back into the container but permitting downward flow from the container 32 into the reservoir 30 inasmuch as the hoses 78 are connected to the respective containers 32 in a manner set forth hereinafter. In addition, a vent tank 96 is supported adjacent the upper end of the frame and is communicated with the interior of a hot water line (not shown) running to spigot 26 through tube 102 and tube 98 including a fitting 100 extending through the plug 82 as illustrated in FIG. 3 provides return flow to reservoir 30 so that in the event of pressure buildup in the hot water line, such as by steam or the like, such pressure will expand into the tank 96. The shape and size of the vent tank may vary with the inlet or inlet hose being above maximum level of fluid in the container and should be removable and cleanable and may be supported in any suitable manner and a check valve may be provided in tube 98 to prevent reverse flow from reservoir 30 to tank 96.

As set forth previously, the container 32 is provided with a tubular discharge member 62 incorporated into a filler cap or the like as illustrated in prior U.S. Pat. No. 3,430,824. The new tubular member 62 of this invention is provided with an inner tubular member 104 having a lateral opening 106 adjacent the inner end thereof which communicates with the interior of the container. A new slidable tubular valve 108 is provided in the inner tubular member 104 and includes a flange or handle 110 thereon by which the tubular valve 108 can be reciprocated so that the inner end thereof closes off the opening 106. The outer end of the tubular valve 108 has, in FIGS. 4 and 5, been modified from having a lateral opening as in U.S. Pat. No. 3,223,117 or U.S. Pat. No. 3,430,824 to include an end opening provided with a dust cap or closure 112 tethered to the fitting 60 by a plastic flexible strap 114. The interior of the tubular valve 108 is provided with a pair of peripheral ribs 116 and the exterior thereof is provided with a projection 118 adjacent the inner end thereof for resiliently engaging a corresponding recess to retain the tubular valve in closed position and also limiting its outward movement as illustrated in FIG. 4. When the valve 108 is in closed position, the inner tubular end sealingly engages a tapered projection 109 in the closed end of tubular member 104 as shown in FIG. 5. Also, as illustrated in FIG. 4 and as illustrated more specifically in FIG. 9, the upper end of the hose 78 is provided with a fitting 120 which has a serrated tubular extension 122 frictionally and sealingly engaged with the hose, as illustrated in FIG. 4, at one end thereof, a flange 124 at the center thereof and a tubular tapered extension 126 at its other end adapted to telescope into the interior of the inner valve 108 and become connected thereto by virtue of the tubular extension 126 having a pair of peripheral recesses or grooves 128 receiving the internal ribs 116 thus connecting the fitting 120 to the tubular valve 108 when it has been inserted therein thus enabling the tubular valve 108 to be moved outwardly to its open position as illustrated in FIG. 4 so that the tubular valve 108 will be communicated with the interior of the container 32 through the lateral opening 106 and the interior of the tubular valve 108 will also be communicated with the hose and thus the reservoir through the passageway through the fitting 120 as illustrated in FIG. 4. Thus, with this construction, the new valve is open at the end rather than laterally adjacent the outer end and the connector is connected thereto as a longitudinal extension of the tubular valve.

In FIG. 6, the tubular valve is designated by numeral 130 and is the same as that illustrated in FIGS. 4 and 5 except that the peripheral wall of the valve 130 is provided with a lateral opening 132 rather than the opening being longitudinally with the outer end of the valve being closed in the manner illustrated in the aforementioned patent. In this construction, the connector 134 is connected to the hose 78 in the same manner as in FIG. 4 and provided with a flange 136 thereon. The tubular extension 138 on the fitting 134 is provided with an inclined open end 140 which penetrates through the opening 132 and a peripheral sealing ring 142 in the form of a rib is provided on the extension 138 spaced from the inclined end 140. Also provided on the flange 136 is indicia 144 indicating the manner in which the inclined end 140 should be associated with the tubular valve 130 so that it will be in communication with and facing the interior of the valve 130 which is in communication with the interior of the container when the valve 130 has been pulled outwardly to its extended or outward position. In this embodiment, the connection is usually made with the container while the fitting 60 is in an uppermost position in order to prevent spillage and, of course, the hose 78 must be sufficiently long to enable this to be accomplished. This adapter provides the benefit of not having to modify the existing valve on the container, but it can also be used with the new valve as illustrated in FIGS. 4 and 5 inasmuch as the extension may also fit into the interior of the hollow valve 108.

Figure 7:
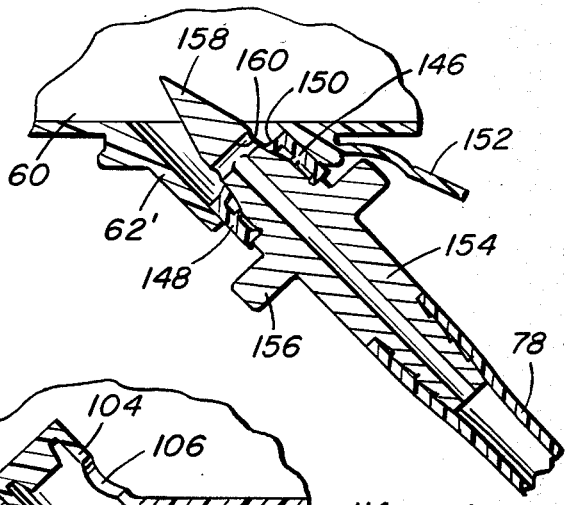
FIG. 7 is a sectional view of a puncture-type connector.

FIG. 7 illustrates a modified fitting 60' for the container having a tubular member 62' that includes an inner tubular member 146 with a pair of peripheral ribs 148 thereon, a ruptureable seal film 150 at the inner end thereof and a dust cover 152 closing the outer end thereof in the same manner as in FIGS. 4 and 5. In this construction, no internal valve structure is provided and a fitting 154 connected to the hose 78 is provided which includes a handle flange 156 and a pointed extension 158 which, when inserted into the tubular member 146, will puncture the film 150. A transverse passageway 160 is provided in the extension 158 inwardly of the pointed end thereof to communicate the interior of the container 32 with the longitudinal passageway through the fitting 154 into the hose 78. The outer periphery of the fitting 154 is provided with peripheral recess areas or grooves receiving the ribs 148 to secure the fitting 154 sealingly to the container 32. Thus, in this construction, there is an elimination of the two-part structure, but it cannot be disconnected from only partially emptied containers unless the container is inverted so that the fitting 60' is in uppermost position.

Figure 13:
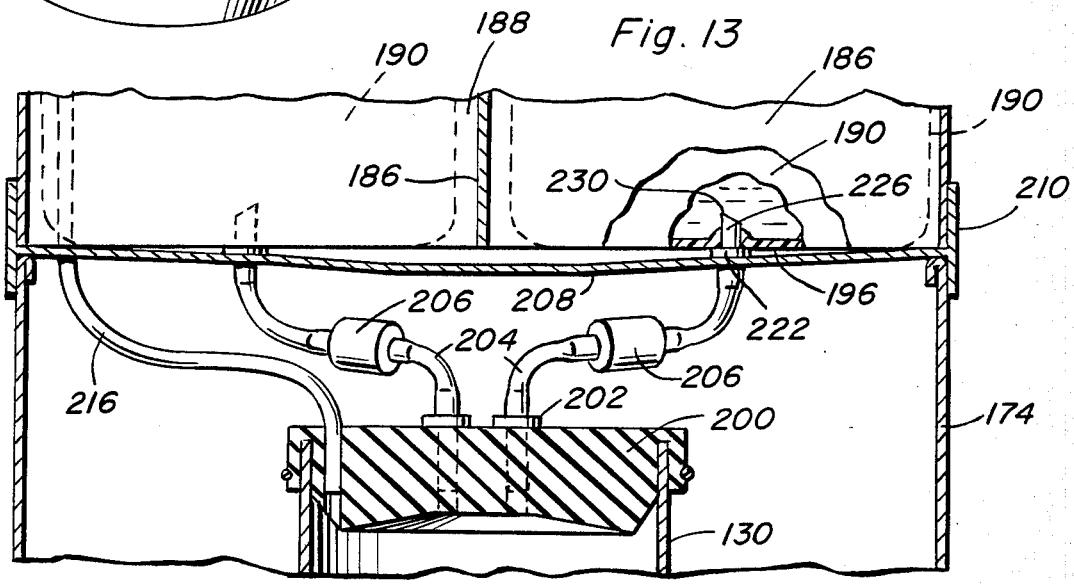
FIG. 13 is a fragmental sectional view taken substantially upon a plane passing along section line 13—13 of FIG. 11 illustrating the association of a reservoir plug, connectors and the puncture member for the containers mounted in the spill tray.

Referring now to FIGS. 11–16, the embodiment of this invention illustrated therein is generally designated by numeral 170 and is disclosed as being mounted on a dispenser 172 having the usual cabinet 174, dispensing faucets 176 overflow catch basin 178 and reservoir 180 comparable to the reservoir to reservoirs 30 disclosed in the embodiment of the invention illustrated in FIGS. 1–10. In this construction, the adapter 170 includes a case 182 including a peripheral wall 184 having vertically disposed intersecting partitions 186 therein forming four equal compartments 188 each of which is adapted to vertically slidably receive a container 190 having a tranverse handle 192 on the upper end thereof and a filling projection 194 adjacent thereto in which the container 190 is provided with a generally flat bottom surface 196 and the entire container may be constructed of plastic material. This enables the containers 190 to be vertically assembled into the compartments 188 and, as illustrated, an optional dust cover 198 is provided for the upper end of the peripheral wall 184 thus protecting the interior of the case 182 from dust, and the like. In this construction, the reservoir plug 200 is quite similar to that illustrated in FIGS. 1–10 except that four fittings 202 are provided with each of the fittings being provided with a hose 204 having a check valve 206 incorporated therein. Also, a spill plate or tray 208 is oriented above the reservoir 180 and actually forms a transverse wall of a peripheral frame member 210 which telescopes down over the cabinet 174 and telescopically receives the lower end of the peripheral wall 184 as illustrated in FIG. 13. The spill tray 208 is provided with an inclined or slanted bottom with the low point therein being communicated with the catch basin 178 by a drain hose illustrated in broken line in FIG. 11 and identified by numeral 212. At the upper end of the wall 184, a vent tank 214 is provided which is communicated with the hot water line through a hose 215 and with the reservoir through hose 216 in the same manner as in FIGS. 1–10 and a drain hose 212 is provided to the catch basin 178 from the spill tray 208. A clamp ring 218 is provided for the outer periphery of the plug or stopper 200 for the reservoir 180 which operates in the same manner as the structure illustrated in FIGS. 1–10 with the closure plug or stopper 200 being the same except that four fittings 202 are provided for receiving four hoses 204 to communicate each of the four containers 190 with the reservoir 180 with the check valves 206 preventing reverse flow from the reservoir 180 back into the container 190 so that reverse flow back into the containers will not occur which might result when all of the containers have been substantially or completely emptied and full containers are placed into the compartments 188 in a sequential manner.

The spill tray or plate 208 is provided with four connectors 220 mounted therein with one of the connectors being located centrally in each of the compartments 188. Each connector 220 includes a peripheral flange 222 resting against and secured to the upper surface of the spill tray 208 and a depending extension 224 provided with serrations or barbs on the exterior thereof receives the upper end of the hose 204 in a manner which communicates the hose 204 with the tubular interior of the connector 220. The upper end of the connector 220 includes an extension 226 terminating in an inclined upper edge 228 which at its uppermost point includes a cutting tip or penetrating tip 230 which will penetrate the bottom surface 196 of the container 190 when the container 190 is positioned into a compartment 188 and moved downwardly into contacting relation with the spill plate 208 with the pointed tip 230 which may be constructed of metal, penetrating and cutting an aperture in the buttom 196, as illustrated in FIG. 13 thus communicating the interior of the container 190 with the reservoir 180.

This structure greatly facilitates replacement of empty containers in that no manual connection has to be made by inserting connectors manually into existing valves or fittings. In this arrangement, it is only necessary to vertically lift the empty containers 190 from the compartments and replace them with filled containers being certain that downward force is exerted on the filled containers sufficient to make certain that the penetrating pointed tip 230 of the connector 220 has penetrated into the interior of the bottom surface 196 and puncture the upper end of the container with an ice pick, knife, or the like. The plastic material from which the container 190 is made will effectively seal around the extension 226 and a minute amount of water left in the container when it is moved upwardly will drain through connector 220 as the bottom of the container will flex downwardly as the container is lifted. Any leakage will drain into the spill tray 208 and thus into the catch basin 178. The containers will normally be carried in a rigid case such as a dairy case from a truck or other transporting device to the point of use, such as a home, office, or the like, and could be placed in either embodiment of the invention depending upon the type of adapter used and the type of container used, thus enabling the containers to be constructed of appropriate plastic material having appropriate strength characteristics but yet quite inexpensive so that the containers may be constructed so economically that it is feasible for them to be thrown away after use, thus eliminating the necessity of taking the containers back to a filling plant for sterilization and reuse as is necessary when glass bottles are used. The material from which the containers are made is readily burnable and will not produce noxious gases other than the usual products of combustion resulting from burning natural gas.

In the embodiment illustrated in FIGS. 11–16, the connector 220 may be constructed by rigid plastic material but a metal point or tip at 230 may be incorporated into the connector to begin the puncture of the bottom 196 of the plastic container, depending upon the rigidity of the bottom 196 and the materials from which the connector 220 is constructed which preferably is a plastic material with a metal point or alternatively, a metal connector may be provided in which the inclined edge thereof may be sufficiently sharp to provide a puncture of the bottom 196 of the container.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a liquid dispenser having a reservoir and discharge spigot means communicating therewith, at least one disposable liquid supply container, a support structure supporting the container at an elevation above the reservoir, reservoir closure means for sealing the reservoir against entry of ambient air, and means communicating the reservoir with the container for enabling gravity flow of liquid from the container to the reservoir through the closure means without the liquid coming into contact with ambient air, said closure means for the reservoir including a resilient stopper telescoped into an opening in the top of the reservoir and secured in sealed relation thereto, said means communicating the reservoir with the container including a tube having one end communicating with the reservoir through said stopper in sealed relation thereto, the other end of said tube having an end fitting communicating with the interior of the container in sealed relation thereto, said support structure including an upwardly opening recess to enable unrestricted insertion and removal of the container in relation to the recess with the weight of the container and liquid retaining the container in the recess and retaining the end fitting and container in sealed relationship, said support structure including a vertically disposed housing receiving the container with the housing including a bottom panel, said end fitting on the tube being rigidly affixed to the bottom panel and extending therethrough with the fitting including a pointed upper end for penetrating through the bottom of the container when the container is moved downwardly into a position adjacent the bottom panel, said fitting having a lower end extending below the bottom panel and sealingly connected to the tube, said end fitting being sealed to the bottom panel so that any leakage will be retained on the upper surface of the bottom panel, said bottom panel being slanted and provided with a drain to remove any leaked liquid, the upper end of the end fitting including a beveled end terminating in a pointed tip having a metallic cutting edge associated therewith for forming an aperture in the bottom of the container when it is lowered toward the bottom panel.

2. The structure as defined in claim 1 wherein said reservoir includes an open upper end, said stopper including a downwardly opening groove telescopically receiving the upper end of the reservoir, and a clamping band encircling the stopper outwardly of the groove to secure the stopper in place on the reservoir.

3. In combination, a liquid dispenser having a reservoir and discharge spigot means communicating therewith, at least one disposable liquid supply container, a support structure supporting the container at an elevation above the reservoir, reservoir closure means for sealing the reservoir against entry of ambient air, and means communicating the reservoir with the container for enabling gravity flow of liquid from the container to the reservoir through the closure means without the liquid coming into contact with ambient air, said closure means for the reservoir including a resilient stopper telescoped into an opening in the top of the reservoir and secured in sealed relation thereto, said means communicating the reservoir with the container including a tube having one end communicating with the reservoir through said stopper in sealed relation thereto, the other end of said tube having an end fitting communicating with the interior of the container in sealed relation thereto, said support structure including an upwardly opening recess to enable unrestricted insertion and removal of the container in relation to the recess with the weight of the container and liquid retaining the container in the recess and retaining the end fitting and container in sealed relationship, said reservoir including an open upper end, said stopper including a downwardly opening groove telescopically receiving the upper end of the reservoir, and a clamping band encircling the stopper outwardly of the groove to secure the stopper in place on the reservoir, said support structure including a vertically disposed housing receiving the container with the housing including a bottom panel, said end fitting on the tube being rigidly affixed to the bottom panel and extending therethrough with the fitting including a pointed upper end for penetrating through the bottom of the container when the container is moved downwardly into a position adjacent the bottom panel, said fitting having a lower end extending below the bottom panel and sealingly connected to the tube, said end fitting being sealed to the bottom panel so that any leakage will be retained on the upper surface of the bottom panel, said bottom panel being slanted and provided with a drain to remove any leaked liquid, the upper end of the end fitting including a beveled end terminating in a pointed tip having a metallic cutting edge associated therewith for forming an aperture in the bottom of the container when it is lowered toward the bottom panel, said housing being defined by a substantially vertical peripheral wall, said dispenser including a cabinet defined by a vertical peripheral wall of generally the same dimensions as the housing, a peripheral frame member telescopically engaging the upper end of the cabinet and the lower end of the housing for retaining the peripheral walls in vertical, aligned supporting relationship, said housing including transversely extending, vertically disposed partitions forming a plurality of recesses for receiving a plurality of liquid supply containers, each of said recesses including an end fitting and tube interconnecting the end fitting and stopper for communicating all of the containers with the reservoir, the upper end of the housing being open to enable vertical insertion and removal of the containers.

4. The structure as defined in claim 3 wherein said reservoir includes a vent tube communicating therewith through the stopper in sealed relation thereto, and a vent tank mounted in the upper end of the housing with the vent tube connected therewith, each of said tubes communicating the container with the reservoir including a check valve therein to prevent reverse flow from the reservoir to the container.

* * * * *